US007999487B2

(12) United States Patent
Szczeszynski

(10) Patent No.: US 7,999,487 B2
(45) Date of Patent: Aug. 16, 2011

(54) ELECTRONIC CIRCUIT FOR DRIVING A DIODE LOAD WITH A PREDETERMINED AVERAGE CURRENT

(75) Inventor: Gregory Szczeszynski, Hollis, NH (US)

(73) Assignee: Allegro Microsystems, Inc., Worcester, MA (US)

( * ) Notice: Subject to any disclaimer, the term of this patent is extended or adjusted under 35 U.S.C. 154(b) by 565 days.

(21) Appl. No.: 12/136,347

(22) Filed: Jun. 10, 2008

(65) Prior Publication Data

US 2009/0302776 A1 Dec. 10, 2009

(51) Int. Cl.
*H05B 41/16* (2006.01)
*G05F 1/00* (2006.01)

(52) U.S. Cl. ..... 315/291; 315/246; 323/285

(58) Field of Classification Search ..... 315/247, 315/224, 291, 307, 312
See application file for complete search history.

(56) References Cited

U.S. PATENT DOCUMENTS

| | | | | |
|---|---|---|---|---|
| 4,739,226 | A * | 4/1988 | Murata | 315/224 |
| 6,222,385 | B1 | 4/2001 | Kang | |
| 6,621,235 | B2 | 9/2003 | Chang | |
| 6,636,104 | B2 | 10/2003 | Henry | |
| 6,690,146 | B2 | 2/2004 | Burgyan et al. | |
| 6,822,403 | B2 | 11/2004 | Horiuchi et al. | |
| 6,930,679 | B2 | 8/2005 | Wu et al. | |
| 6,963,175 | B2 * | 11/2005 | Archenhold et al. | 315/291 |
| 7,116,086 | B2 | 10/2006 | Burgyan et al. | |
| 7,129,679 | B2 | 10/2006 | Inaba et al. | |
| 7,148,632 | B2 | 12/2006 | Berman et al. | |
| 7,291,989 | B2 | 11/2007 | Namba et al. | |
| 7,307,614 | B2 | 12/2007 | Vinn | |
| 7,317,403 | B2 | 1/2008 | Grootes et al. | |
| 7,375,472 | B2 | 5/2008 | Wong et al. | |
| 7,466,082 | B1 * | 12/2008 | Snyder et al. | 315/200 A |
| 7,479,743 | B2 | 1/2009 | Namba et al. | |
| 7,482,765 | B2 | 1/2009 | Ito et al. | |
| 7,528,551 | B2 * | 5/2009 | Ball | 315/247 |
| 7,675,245 | B2 | 3/2010 | Szczeszynski et al. | |
| 2004/0051478 | A1 * | 3/2004 | Otake et al. | 315/291 |
| 2004/0135522 | A1 | 7/2004 | Berman et al. | |
| 2004/0251854 | A1 * | 12/2004 | Matsuda et al. | 315/291 |

(Continued)

FOREIGN PATENT DOCUMENTS

EP 1 079 667 A2 2/2001

(Continued)

OTHER PUBLICATIONS

Szczeszynski et al.; "Electronic Circuit for Driving a Diode Load;" U.S. Appl. No. 11/619,675, filed Jan. 4, 2007.

(Continued)

*Primary Examiner* — Jacob Y Choi
*Assistant Examiner* — Henry Luong
(74) *Attorney, Agent, or Firm* — Daly, Crowley, Mofford & Durkee, LLP

(57) ABSTRACT

Electronic circuits and methods include provisions for passing a first current through a diode during a first time interval and for passing a second different current through the diode during a second different time interval. The first current is selected to achieve a predetermined voltage at a node of the diode. A duty cycle of the first current relative to the second current is selected to achieve a predetermined average current passing through the diode. In some arrangements, the diode is a light emitting diode.

22 Claims, 8 Drawing Sheets

U.S. PATENT DOCUMENTS

| | | | | |
|---|---|---|---|---|
| 2005/0088207 | A1 | 4/2005 | Rader et al. | |
| 2005/0104542 | A1 | 5/2005 | Ito et al. | |
| 2005/0110469 | A1 | 5/2005 | Inaba et al. | |
| 2005/0156540 | A1* | 7/2005 | Ball | 315/307 |
| 2005/0243022 | A1 | 11/2005 | Negru | |
| 2005/0243041 | A1 | 11/2005 | Vinn | |
| 2006/0028147 | A1* | 2/2006 | Shinmen et al. | 315/209 R |
| 2006/0114954 | A1 | 6/2006 | Wong et al. | |
| 2006/0125320 | A1 | 6/2006 | Namba et al. | |
| 2006/0139299 | A1 | 6/2006 | Tsuchiya | |
| 2006/0170287 | A1 | 8/2006 | Ito et al. | |
| 2007/0120506 | A1 | 5/2007 | Grant | |
| 2007/0267978 | A1* | 11/2007 | Shteynberg et al. | 315/247 |
| 2008/0048573 | A1* | 2/2008 | Ferentz et al. | 315/193 |
| 2008/0144236 | A1 | 6/2008 | Chiang et al. | |
| 2009/0021384 | A1* | 1/2009 | Jacubovski et al. | 340/653 |
| 2009/0128045 | A1 | 5/2009 | Szczeszynski et al. | |
| 2009/0302776 | A1 | 12/2009 | Szczeszynski et al. | |
| 2010/0072922 | A1 | 3/2010 | Szczeszynski et al. | |

FOREIGN PATENT DOCUMENTS

| | | | |
|---|---|---|---|
| EP | 1 079 667 | A3 | 2/2001 |
| JP | 3-196280 | | 8/1991 |
| WO | WO 00/13310 | | 3/2000 |
| WO | WO 02/03087 | A1 | 1/2002 |
| WO | WO 2007/043389 | A1 | 4/2007 |
| WO | WO 2007/096868 | A1 | 8/2007 |
| WO | WO 2008/086050 | A2 | 7/2008 |
| WO | WO 2008/086050 | A3 | 7/2008 |
| WO | WO 2009/064682 | A2 | 5/2009 |
| WO | WO 2009/064682 | A3 | 5/2009 |

OTHER PUBLICATIONS

Allegro Microsystems, Inc., Data Sheet A8500, Flexible WLED/RGB Backlight Driver for Medium Size LCD's, Dec. 8, 2006, pp. 1-15.

"Charge-Pump and Step-Up DC-DC Converter Solutions for Powering White LEDs in Series or Parallel Connections:" Dallas Semiconductor MAXIM; Apr. 23, 2002; 15 pages.

"Integrated 8-Channel LED Drivers with Switch-Mode Boost and SEPIC Controller;" MAXIM; MAX 16807/MAX76808; #19-6055; Oct. 2006; pp. 1-21.

Linear Technology, Design Notes, Short-Circuit Protection for Boost Regulators, 1997, pp. 1-2.

Rohm, Data Sheet BD6066GU, Silicon Monolithic Integrated Circuit, Apr. 2005, pp. 1-6.

"White LED Driver IC;" NPC Nippon Precision Circuits, Inc.; SM8132A; May 2005; pp. 1-18.

"WLED Backlight Drivers with True Shutdown and OVP;" A8432 and A8433: Allegro MicroSystems, Inc. Concept Data Sheet; Jan. 25, 2005; 6 pages.

PCT Search Report and Written Opinion for the ISA of PCT/US2008/082934 mailed Dec. 15, 2009.

Bakker et al.; "A CMOS Nested-Chopper Instrumentation Amplifier with 100-nV Offset;" IEEE Journal of Solid-State Circuits; vol. 35, No. 12; Dec. 2000; pp. 1877-1883.

Burkhart et al.; "A Monolithically Integrated 128 LED-Driver and its Application;" IEEE Transactions on Consumer Electronics; vol. CE-32, No. 1; Feb. 1986; pp. 26-31.

Szczeszynski et al.; U.S. Appl. No. 12/267,645, filed Nov. 10, 2008; Entitled: "Electronic Circuits for Driving Series Connected Light Emitting Diode Strings".

PCT Search Report and Written Opinion of the ISA for PCT/US2008/050026 dated Aug. 29, 2008.

PCT International Preliminary Report on Patentability of the ISA dated May 27, 2010 for PCT/US2008/082934, pp. 1-14.

MAXIM Data Sheet; MAX1570; "White LED Current Regulator with 1x/1.5x High-Efficiency Charge Pump;" #19-2526; Jul. 2002; pp. 1-12.

MAXIM Data Sheet; MAX1574; "180mA, 1x/2x, White LED Charge Pump in 3mm×3mm TDFN;" #19-3117; Dec. 2003; pp. 1-9.

MAXIM Data Sheet; MAX1576; "480mA White LED 1x/1.5x./2x Charge Pump for Backlighting and Camera Flash;" #19-3326; Aug. 2005; pp. 1-14.

Maxim, Data Sheet; MAX16807/MAX16808, "Integrated 8-Channel LED Drivers with Switch-Mode Boost and SEPIC Controller", Oct. 2006, pp. 1-21.

Partial PCT Search Report received with Invitation to Pay Additional Fees in PCT/US2008/050026 dated Jun. 16, 2008.

Image File Wrapper downloaded on Dec. 14, 2009 for U.S. Appl. No. 11/619,675, filed Jan. 4, 2007 Part 1 of 2; pp. 1-305.

Image File Wrapper downloaded on Dec. 14, 2009 for U.S. Appl. No. 11/619,675, filed Jan. 4, 2007 Part 2 of 2; pp. 1-313.

MAXIM; Dallas Semiconductor; "Charge-Pump and Step-Up DC-DC Converter Solutions for Powering White LEDs in Series or Parallel Connections:" Apr. 23, 2002; 15 pages.

Nippon Precision Circuits, Inc.; SM8132A; "White LED Driver IC;" Nippon Precision Circuits, Inc.; May 2005; pp. 1-18.

PCT Partial Search Report and Invitation to Pay Additional Fees dated Jun. 16, 2008 for PCT/US/2008/050026.

Image File Wrapper downloaded on Nov. 29, 2010 for U.S. Pat. No. 7,675.245; Timeframe Dec. 14, 2009-Nov. 29, 2010; 198 pages.

* cited by examiner

Vreg
24
OVP Comparator
46
48
Vref 1
50
OVP Fault
22
20
18
16
12
14
Vps
26
28
30
32
PWM Controller
OVP Fault
50
34
36
38
Vref 2
40
42
Signal Selection Circuit
mv1
mv2
mv3
200
202
Ext. PWM
78
206c
208c
214c
216c
210c
218c
I/V Control Circuit
212c
204c
210b
Ext. PWM
to mv1
208b
206b
214b
216b
218b
I/V Control Circuit
212b
204b
210a
Ext. PWM
to mv2
208a
206a
214a
216a
218a
I/V Control Circuit
212a
204a
Ext. PWM
to mv3
52
54
56

ELECTRONIC CIRCUIT FOR DRIVING A DIODE LOAD WITH A PREDETERMINED AVERAGE CURRENT

CROSS REFERENCE TO RELATED APPLICATIONS

Not Applicable.

STATEMENT REGARDING FEDERALLY SPONSORED RESEARCH

Not Applicable.

FIELD OF THE INVENTION

This invention relates generally to electronic circuits and, more particularly, to electronic circuits used to drive a diode load, for example, a light emitting diode (LED) load.

BACKGROUND OF THE INVENTION

A variety of electronic circuits are used to drive diode loads and, more particularly, to control electrical current through strings of series connected light-emitting diodes (LEDs), which, in some embodiments, form an LED display, or, more particularly, a backlight for a display, for example, a liquid crystal display (LCD). It is known that individual LEDs have a variation in forward voltage drop from unit to unit. Therefore, the strings of series connected LEDs can have a variation in forward voltage drop.

Strings of series connected LEDs can be coupled to a common switching regulator, e.g., a boost switching regulator, at one end of the LED strings, the switching regulator configured to provide a high enough voltage to supply each of the strings of LEDs. The other end of each of the strings of series connected LEDs can be coupled to a respective current sink, configured to sink a relatively constant current through each of the strings of series connected LEDs.

It will be appreciated that the voltage generated by the common switching regulator must be a high enough voltage to supply the one series connected string of LEDs having the greatest total voltage drop, plus an overhead voltage needed by the respective current sink. In other words, if four series connected strings of LEDs have voltage drops of 30V, 30V, 30V, and 31 volts, and each respective current sink requires at least one volt in order to operate, then the common boost switching regulator must supply at least 32 volts.

While it is possible to provide a fixed voltage switching regulator that can supply enough voltage for all possible series strings of LEDs, such a switching regulator would generate unnecessarily high power dissipation when driving strings of series connected LEDs having less voltage drop. Therefore, in some LED driver circuits, the voltage drops through each of the strings of series connected LEDs are sensed and the common switching regulator is controlled to generate an output voltage only high enough to drive the series connected LED string having the highest voltage drop.

In these arrangements, it should be recognized that the other series connected LED strings, which do not have the highest voltage drop, will suffer a higher power dissipation than that which is actually necessary to drive them, since the voltage used to drive them is higher than necessary. Particularly in battery powered systems, where power is at a premium, the higher power dissipation is undesirable.

SUMMARY OF THE INVENTION

In accordance with one aspect of the present invention, an electronic circuit includes a current controlled circuit having a current sense output node at which a current sense signal is provided representative of a current flowing through the current controlled circuit, a voltage sense output node at which a voltage sense signal is provided representative of a voltage at the voltage sense output node, and a control node configured to receive a control signal to control the current flowing through the current controlled circuit. The electronic circuit also includes a current/voltage control circuit having a current sense input node, a voltage sense input node, and an output node. The current sense input node of the current/voltage control circuit is coupled to the current sense output node of the current controlled circuit, the voltage sense input node of the current/voltage control circuit is coupled to the voltage sense output node of the current controlled circuit, and the output node of the current/voltage control circuit is coupled to the control node of the current controlled circuit. The current/voltage control circuit is configured to provide the control signal at the output node of the current/voltage control circuit resulting in a predetermined voltage at the voltage sense output node of the current controlled circuit and resulting in a predetermined average current passing through the current controlled circuit.

In accordance with another aspect of the present invention, an electronic circuit for lighting a light emitting diode having an anode and a cathode includes a current controlled circuit having a current sense output node at which a current sense signal is provided representative of a current flowing through the current controlled circuit, a voltage sense output node at which a voltage sense signal is provided representative of a voltage at the voltage sense output node, and a control node configured to receive a control signal to control the current flowing through the current controlled circuit. The voltage sense output node of the current controlled circuit is configured to couple to a selected one of the anode or the cathode of the light emitting diode. The electronic circuit also includes a switching regulator having an input node, an output node, and a control node. The output node of the switching regulator is configured to couple to a selected one of the anode of the light emitting diode or to the voltage sense output node of the current controlled circuit. The electronic circuit also includes a current/voltage control circuit having a current sense input node, a voltage sense input node, and an output node. The current sense input node of the current/voltage control circuit is coupled to the current sense output node of the current controlled circuit, the voltage sense input node of the current/voltage control circuit is coupled to the voltage sense output node of the current controlled circuit, and the output node of the current/voltage control circuit is coupled to the control node of the current controlled circuit. The current/voltage control circuit is configured to provide the control signal at the output node of the current/voltage control circuit resulting in a predetermined voltage at the voltage sense output node of the current controlled circuit and resulting in a predetermined average current passing through the current controlled circuit.

In accordance with another aspect of the present invention, a method for an LED driver circuit comprising a switching regulator includes passing a first current through an LED and through a current controlled circuit having a current sense output node, a voltage sense output node, and a control node, wherein the first current is selected to result in a predetermined voltage at the voltage sense output node of the current controlled circuit. The method further includes alternating between the first current and a second different current passing through the LED and through the current controlled circuit in order to achieve a predetermined average current through the LED and through the current controlled circuit.

With the above arrangements, the series connected diode strings, and, in some arrangements, the series connected LED strings, can be driven or powered in a way that provides a high efficiency, i.e., a low power loss through most of, or through every one of, the series connected LED strings.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Before describing the present invention, some introductory concepts and terminology are explained. As used herein, the term "boost switching regulator" is used to describe a known type of switching regulator that provides an output voltage higher than an input voltage to the boost switching regulator. While a certain particular circuit topology of boost switching regulator is shown herein, it should be understood that boost switching regulators have a variety of circuit configurations. As used herein, the term "buck switching regulator" is used to describe a known type of switching regulator that provides an output voltage lower than an input voltage to the buck switching regulator. It should be understood that there are still other forms of switching regulators other than a boost switching regulator and other than a buck switching regulator, and this invention is not limited to any one type.

As used herein, the term "current regulator" is used to describe a circuit or a circuit component that can regulate a current passing through the circuit or circuit component to a predetermined, i.e., regulated, current. A current regulator can be a "current sink," which can input a regulated current, or a "current source," which can output a regulated current. A current regulator has a "current node" at which a current is output in the case of a current source, or at which a current is input in the case of a current sink.

As used herein, the term "current controlled circuit" is used to describe a circuit (source or sink) that can regulate an average current passing through the circuit or circuit component to a selected, i.e., regulated, average current. In order to achieve the regulated average current, the current controlled circuit can change between two or more currents at periodic intervals or from time to time.

Figure 1:
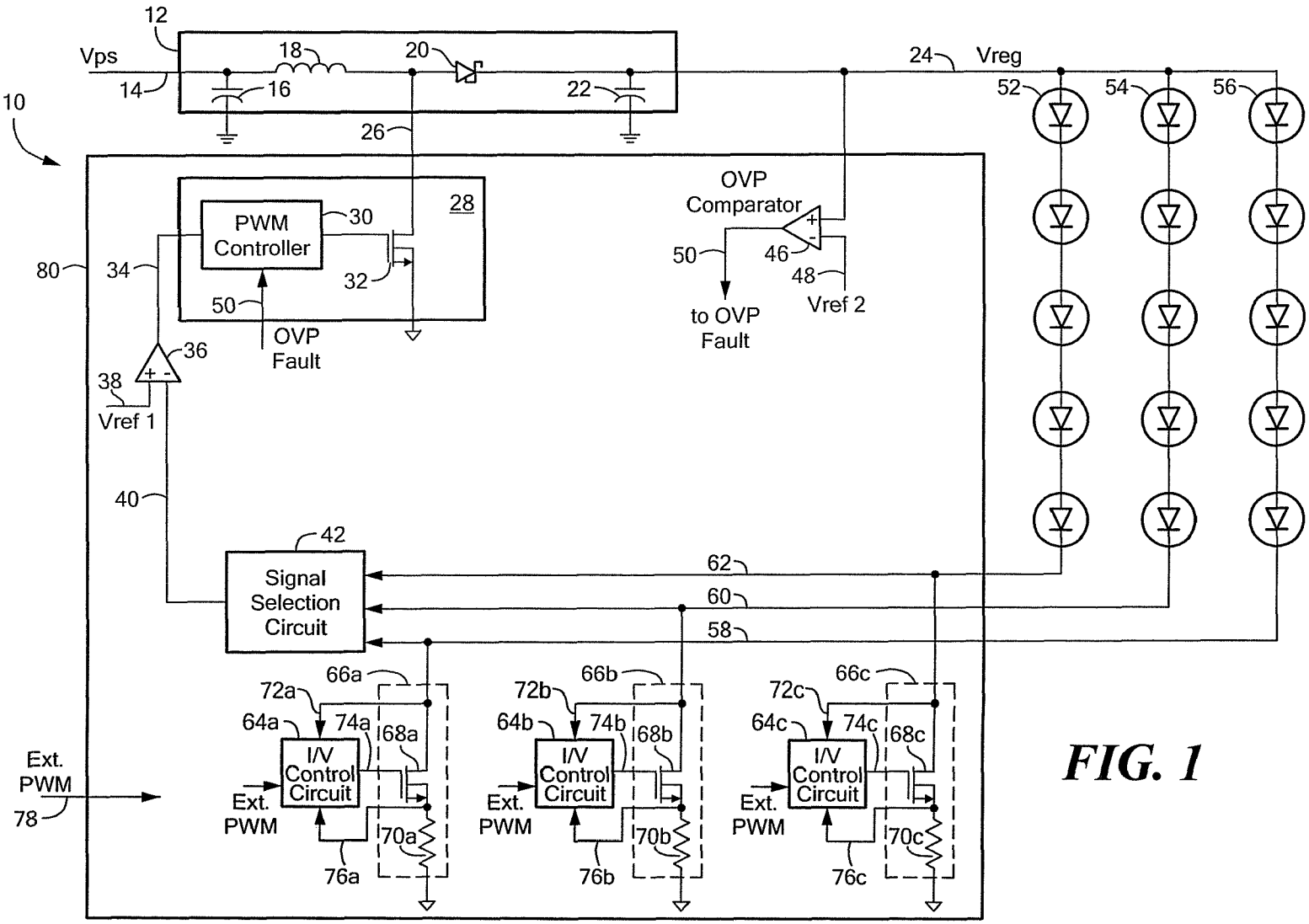
FIG. 1 is a block diagram of an electronic circuit for driving a diode load, the electronic circuit having current controlled circuits and current/voltage control circuits configured to provide control of a boost switching regulator.

Referring to FIG. 1, an exemplary electronic circuit 10 includes a boost switching regulator 12 coupled to series connected diode strings 52-56, which, in some arrangements, are series connected light emitting diode (LED) strings as may form an LED display or a backlight for a display, for example, a liquid crystal display (LCD). The boost switching regulator 12 and the series connected LED strings 52-56 are coupled to an integrated circuit 80. The boost switching regulator 12 is configured to accept a voltage 14 at an input node of the boost switching regulator 12 and to generate a relatively higher regulated output voltage 24 at an output node of the boost switching regulator 12.

In some embodiments, the boost switching regulator 12 includes an inductor 18 having first and second nodes. The first node of the inductor 12 is coupled to receive the voltage 14. The boost switching regulator 12 also includes a diode 20 having an anode and a cathode. The anode is coupled to the second node of the inductor 18. The boost switching regulator 12 also includes a capacitor 22 coupled between the cathode of the diode 20 and a reference voltage, for example, a ground voltage. The boost switching regulator 12 can include, or is otherwise coupled to, a switching circuit 28 having a switching node that provides a switching signal 26 coupled to the second node of the inductor 18. In some embodiments, an input capacitor 16 can be coupled between the first node of the inductor 18 and a reference voltage, for example, a ground voltage.

The integrated circuit 80 includes current controlled circuits 66*a*-66*c*, coupled to current/voltage control circuits 64*a*-64*c*, respectively. In the illustrative embodiment, the current controlled circuits 66*a*-66*c* are coupled to sink currents from the series connected LED strings 52-56, respectively. However, in other embodiments described below in conjunction with FIG. 3, other current controlled circuits can instead source current to the series connected LED strings 52-56, respectively.

As described more fully below, the current controlled circuits 66*a*-66*c*, which are controlled by the current/voltage control circuits 64*a*-64*c*, respectively, are each configured to sink a predetermined average current, which can be the same average current, or which can be different average currents in one or more of the current controlled circuits 66*a*-66*c*.

It should be appreciated that a brightness of the series connected LED strings 52-56 is related to the average current passing through the series connected LED strings 52-56. Therefore, the brightness of each one of the series connected LED strings 52-56 can be maintained to be essentially the same by maintaining the average currents through each one of the series connected LED strings 52-56 to be essentially the same.

It will become more apparent from discussion below that, in operation, a predetermined average current passing through each one of the series connected LED strings 52-56 is achieved by alternating the current controlled circuits 66*a*-66*c* to change periodically between passing a first current and passing a second different current through each one of the series connected LED strings 52-56. The first and/or second currents can be the same or different for each one of the current controlled circuits 66*a*-66*c*, and therefore, for each one of the series connected LED strings 52-56. Thus, when referring to a first current or a second current passing through the series connected LED strings 52-56, it should be understood that the first and second current can be different for each one of the series connected LED strings 52-56. In common however, the first current passing through each one of the series connected LED strings 52-56 results in the series connected LED strings 52-56 being on and emitting light, while the second current passing through each one of the series connected LED strings 52-56 results in the series connected LED strings 52-56 emitting less light, e.g., zero light. With this arrangement, the series connected LED strings 52-56 essentially turn on and off, but at a rate that is not apparent.

The first currents and the second currents occur during first and second periodic time intervals, respectively, which can be the same periodic time intervals or different periodic time intervals for each one of the series connected LED strings 52-56. Thus, when referring to a first periodic time interval or the second periodic time interval associated with the series connected LED strings 52-56, it should be understood that the first and second periodic time intervals can be the same or different time intervals (i.e., different time durations) for each one of the series connected LED strings 52-56. When the time intervals associated with different ones of the series connected LED strings 52-56 are different periodic time intervals, the current controlled circuits 66*a*-66*c* operate asynchronously from each other.

In operation, a respective relative time duration (or duty cycle) for which a particular one of the current controlled circuits 66*a*-66*c* passes the first current versus the second current is determined by a respective one of the current/voltage control circuits 64*a*-64*c*. Operation of the current/voltage control circuits 64*a*-64*c* is more fully described below in conjunction with FIGS. 2 and 2A.

In operation, the first current passing through each one of the current controlled circuits 66*a*-66*c* is generated to achieve respective signals 58-62 (also 72*a*-72*c*) having a predetermined voltage, which can be the same predetermined voltage, or approximately the same predetermined voltage, at the end of each one of the series connected LED strings 52-56, respectively, for the time duration (i.e., the first periodic time interval) that the first current is being passed. However, in other arrangements, the predetermined voltages are not the same. The predetermined voltage is selected to result in a smallest desired power loss associated with the series connected LED strings 52-56 while the first current is flowing. For example, in one particular embodiment, the predetermined voltage, i.e., the signals 58-62 while the first current is being passed, is about one volt. This exemplary voltage is approximately that minimum voltage that can allow the current controlled circuits 66*a*-66*c* to properly operate.

In some arrangements, in operation, each one of the signals 58-62 achieves the same predetermined voltage, e.g., one volt, while the first current is being passed. In order to achieve the same predetermined voltages, the first currents passing through each one of the series connected LED strings 52-56 can be the same or different. However, as will be come apparent from discussion below, it may be advantageous to design the integrated circuit 80 so that, in operation, one of the signals 58, 60, 62 achieves a slightly lower voltage than other ones of the signals 58, 60, 62.

The second current passing through each one of the current controlled circuits 66*a*-66*c*, which is passed during the above-described second periodic time interval, can be any other current selected to achieve the above-described average current, which, as described above, is related to the brightness of each of the series connected LED strings 52-56. In some embodiments, the second current passing through each one of the current controlled circuits 66*a*-66*c* is about zero. While the second current, for example, a current of zero, is being passed, the signals 58-62 at the end of each one of the series connected LED strings 52-56 can transition to a high voltage, for example, as high as the regulated output voltage 24 of the switching regulator 12. In this condition, the voltage across each one of the series connected LED strings 52-56 is substantially zero and the current through each one of the series connected LED strings 52-56 is also substantially zero, resulting in substantially zero power loss through the series connected LED strings 52-56 while the second current is being passed.

Therefore, from the above discussion, it should be appreciated that, in operation, the voltage signals 58-62 tend to take on two values, a first value, which is the above-described predetermined voltage, and which is a relatively low value, during the first periodic time intervals when the current controlled circuits 66*a*-66*c* pass the first current, and a second value, which is a relatively high voltage, during the second periodic time intervals when the current controlled circuits 66*a*-66*c* pass the second current. The predetermined average current passing through the series connected LED strings 52-56 is a combination of the first and second currents, as will be understood.

The current/voltage control circuits 64*a*-64*c* can receive an external PWM signal 78 provided from outside the integrated circuit 80. The external PWM signal 78 can provide a brightness control of the series connected LED strings 52-56. The external PWM signal 78 is described more fully below in conjunction with FIG. 2.

Each one of the current controlled circuits 66*a*-66*c* can have a current sense output node at which a current sense signal 76*a*-76*c*, respectively, is provided representative of a respective current flowing through the current controlled circuit 66*a*-66*c*, a voltage sense output node 68*a*-68*c* at which a voltage sense signal 72*a*-72*c*, respectively, is provided representative of a respective voltage at the voltage sense output node, and a control node configured to receive a control signal 74*a*-74*c*, respectively, to control the current flowing through the respective current controlled circuit 66*a*-66*c*. The voltage sense signals 72*a*-72*c* can be the same as or similar to the signals 58-62, respectively.

In operation, the control signals 74*a*-74*c* can result in the above-described periodic switching between the first current and the second current in order to achieve theabove-described predetermined average currents passing through the current controlled circuits 66*a*-66*c* and therefore through the series connected LED strings 52-56, respectively.

In some embodiments, the integrated circuit 80 can also include a signal selection circuit 42 having input nodes coupled to receive the signals 58-62 and an output node at which an output signal 40 is generated. It should be appreciated that the signals 58-62 can be the same as or similar to the voltage sense output signals 72*a*-72*c*, respectively.

In some embodiments, the integrated circuit 80 also includes an error amplifier 36 coupled to receive the output signal 40 from the output node of the signal selection circuit 42 and to compare the output signal 40 with a first predetermined reference signal 38 to generate an output signal 34.

The switching circuit 28 includes a switching node at which the switching signal 26 is generated and also includes a control node to receive the output signal 34 from the error amplifier 36. A duty cycle of the switching circuit 28 is responsive to the signal 34, and therefore, to the output signal 40 generated by the signal selection circuit 42.

In operation, the output signal 40 at the output node of the signal selection circuit 42 is representative of a signal (e.g., a voltage) selected from among the input signals 58-62. In one particular embodiment, the output signal 40 at the output node of the signal selection circuit 42 is representative of a lowest one of the signals 58-62 (e.g., voltages). Therefore, the output signal 40 at the output node of the signal selection circuit 42 is representative of a largest voltage drop through one of the series connected LED strings 52-56. In another embodiment, the output signal 40 is representative of a combination of the signals 58-62, for example, a sum, an rms sum, or an average.

As described above, in operation, for some embodiments, each one of the signals 58-62 can take on two voltage values, a first lower value when a respective one of the current controlled circuits 66*a*-66*c* is passing the first current and a second higher value when a respective one of the current controlled circuits 66*a*-66*c* is passing the second current. The first lower value and the second higher value of the signals 58, 60, 62, though periodic, can be asynchronous with each other. The first lower value and the second higher value of the signals 58-62 can be the same for each one of the signals 58-62 or they can be different.

One of ordinary skill in the art will be able to design the signal selection circuit 42 having internal comparators and switches, so that an analog output voltage 40 is indicative of a lowest analog signal (e.g., voltage) from among the signals 58-62. In some arrangements, the output signal 40 can have a value representative of only the lowest one of the signals 58-62 when a respective one of the current controlled circuits 66*a*-66*c* is passing the first current.

However, in other arrangements, the output signal 40 can also have other characteristics of one of the signals 58-62. For example, the output signal 40 can at some times have a relatively low value representative of the lowest one of the signals 58-62 when a respective one of the current controlled circuits 66*a*-66*c* is passing the first current and at other times the output signal 40 can have a relatively high value when the respective one of the current controlled circuits 66*a*-66*c* is passing the second current. For these embodiments, the error amplifier 36 can be disabled during the time of the relatively high value of the output signal 40 so that the switching regulator 12 continues to switch.

As described above, in some arrangements it may be advantageous to design the circuit 80 such that one or more of the current controlled circuits 66*a*-66*c* passes a first current such that, during the first current, a slightly lower voltage is achieved in a corresponding one or more of the signals 58-62 than in the other signals 58-62. For example, the signals 58 and 60 can achieve one volt and the signal 62 can achieve 0.9 volts. With this arrangement, there would be less conflict at the signal selection circuit 42 as to which one of the signals 58-62 has the lowest value. Such a conflict could otherwise result in rapid switching and signal glitches in the output signal 40 as a first one of the signals 58-62 is selected as having the lowest voltage and then another one of the signals 58-62 is selected.

In some embodiments, at least one of the LED strings 52-56 is on for one hundred percent of the time. In other words, one of the I/V control circuits 64*a*-64*c* provides the above-described predetermined average current as a continuous current equal to the above-described first current, and does not periodically switch to the above-described second different current.

However, other ones of the I/V control circuits 64*a*-64*c* can periodically switch between the first current and the second different current. With this arrangement, the output signal 40 will be statically low during proper operation, event though some of the I/V control circuits 64*a*-64*c* are periodically switching.

It should be understood that two independent control loops try to set the predetermined voltage appearing as the signals 58-62, which is on the drains 68*a*-68*c* of FETS. In a first loop, a switching I/V control circuit (64*a*-64*c*) will try to set signals 58-62 to have the predetermined voltage. At the same time, the boost switching regulator 12 will try to control voltages of the signals 58-62 by setting the regulated output voltage 24 to also have the same pre-determined voltage. Thus, two different control loops try to control the same voltage, which could cause a conflict. However, the one I/V control circuit 64*a*-64*c* that continually runs at a one hundred percent duty cycle as described above, can indirectly control a voltage at its respective signal 68*a*-68*c* via control of the regulated output voltage 24. Accordingly, the other I/V control circuits 64*a*-64*c* set their voltages directly. Since the LED strings 52-56 with less voltage drop do not control the regulated output voltage 24, there is no control conflict.

In some embodiments, an I/V control circuit 64*a*-64*c* does not achieve a pulse width modulation duty cycle less than one hundred percent until a signal 58-62 exceeds a threshold value. For example, suppose there were four LED strings and a corresponding four predetermined voltages (e.g., 58) at 1.0V, 1.2V, 2V and 3V. In some embodiments, each I/V control circuit can use a threshold of 1.3 volts and can only provide a PWM duty cycle less than one hundred percent if it detects a signal 58-62 above 1.3 volts. In the above example, first and second LED strings would be on one hundred percent of the time, resulting in signals (e.g., signals 58, 60) of 1.0 and 1.2 Volts. However, currents through third and fourth LED strings would be pulse width modulated to generate an on-state predetermined voltage signal (e.g., 62) of 1.3 volts. With this arrangement, the signal selection circuit 42 would not be being affected by the I/V control circuits 64*a*-64*c* that are generating pulse width modulation.

The output signal 40, the error amplifier 36, and the switching circuit 28 control the switching regulator 12 to have a sufficiently high regulated output voltage 24 so that the lowest signal from among the signals 58, 60, 62 is still high enough so that the current controlled circuit 66*a*-66*c* to which it is coupled can properly operate. In other words, the error amplifier 36 operates in a way that moves the switching regulator voltage 24 upward until the output signal 40 is above the first predetermined reference signal 38.

In operation, the current controlled circuit 66*a*-66*c* associated with the one series connected LED string 52-56 having the highest voltage drop can be controlled, such that the duty cycle of the above-described first time interval is one hundred percent in comparison with the above-describe second time interval. In other words, one of the current controlled circuit 66*a*-66*c* is always on and passing the first current. Other ones of the current controlled circuits 66*a*-66*c*, during their respective first time periods, can have a higher current than the one of the current controlled circuits 66*a*-66*c* that is always passing the first current, in order to achieve a larger voltage drop than they would otherwise achieve through the respective series connected LED strings 52-56 to which they couple. Having the higher currents in their respective first time intervals, those current controlled circuits 66*a*-66*c* are controlled to have less than a one hundred percent duty cycle such that they sometimes pass zero current to achieve approximately the same average current in all of the series connected LED stings 52-56.

In other arrangements, all of the average currents in all of the series connected LED strings 52-56 can be scaled equally downward, so that the duty cycle of every series connected LED string 52-56 is less than those described above. In particular, all of the series connected LED strings 52-56 operate at less than one hundred percent in the first current state. In this way, the brightness of all of the series connected LED string 52-56 can be reduced by adjusting all of the duty cycles, while keeping the first currents the same.

In some embodiments, the integrated circuit 80 also includes an over-voltage detection circuit 46 having an input node coupled to receive the switching regulator voltage 24 and an output node at which an over voltage protection (OVP) fault signal 50 is generated. The OVP fault signal 50 is coupled to the PWM controller 30.

In operation, the over-voltage detection circuit 46 is configured to provide the OVP fault signal 50 indicative of the regulated output voltage 24 being above a second predetermined reference signal 48. In some arrangements, the OVP fault signal 50 is a two state binary signal, which takes on a first state when the output voltage 24 has a value below the second predetermined reference signal 48, and which takes on a second state when the output voltage 24 has a value above the second predetermined reference signal 48. The OVP signal 50 can operate to shut down the switching regulator 12, or otherwise limit further upward excursion of the output voltage 24, if the output voltage 24 goes too high.

In some alternate embodiments, some portions of the circuitry shown within the integrated circuit 80 are not within the integrated circuit 80. Partitioning of circuitry between integrated and discrete can be made in any way.

While three series connected LED strings 52-56 are shown, which are coupled to a respective three current controlled circuits 66*a*-66*c*, it should be appreciated more than three or fewer than three series connected LED strings and associated circuitry can be used.

While a signal selection circuit 42 is shown, other arrangements are possible to generate the output signal 40, as described, for example in U.S. Provisional Patent Application No. 60/988,520, filed Nov. 16, 2007, entitled "Electronic Circuits For Driving Series Connected Light Emitting Diode Strings," which application is incorporated by reference herein in its entirety.

Figure 2:
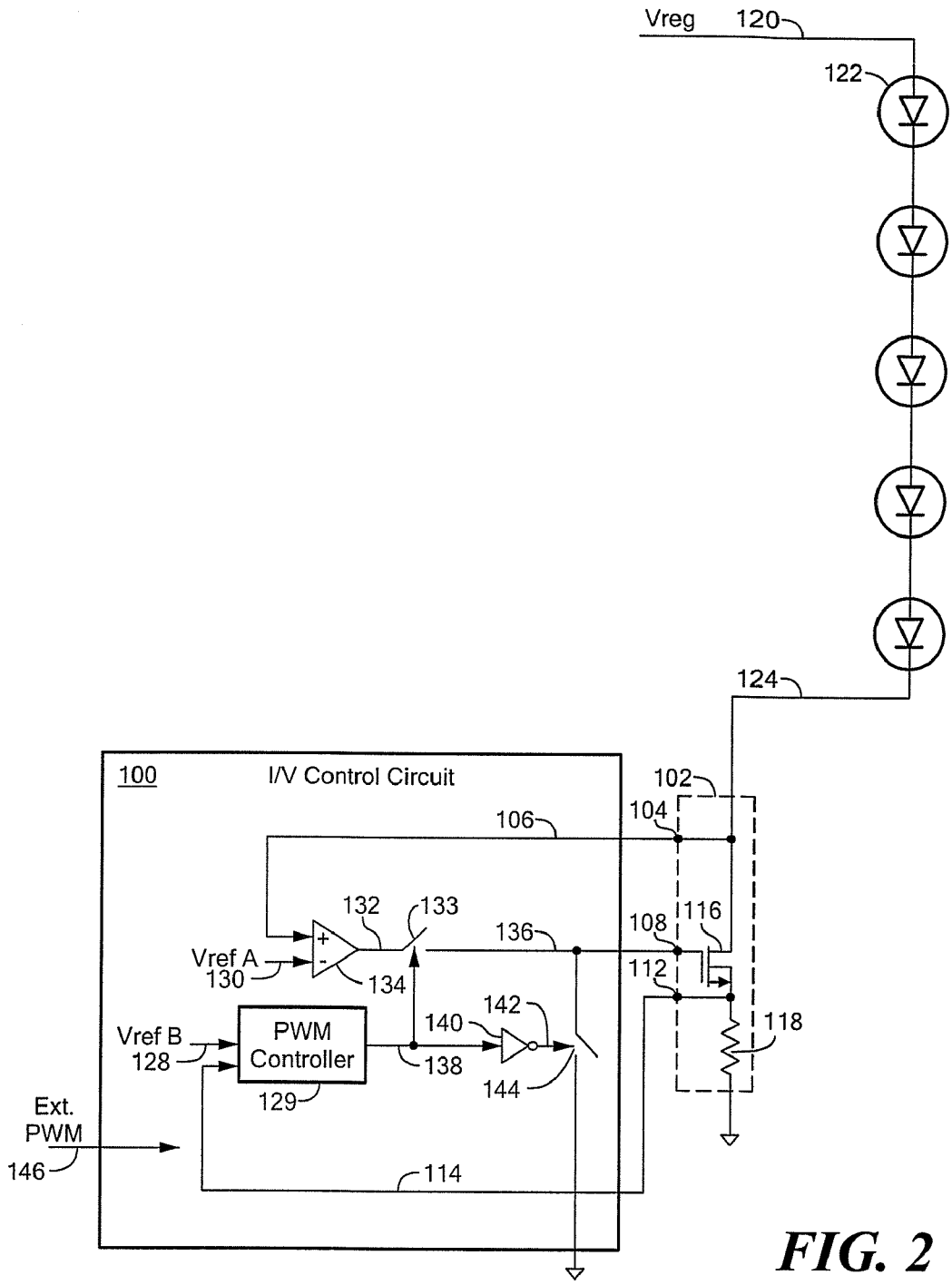
FIG. 2 is a block diagram of a current/voltage control circuit coupled to a current controlled circuit, which is coupled to LEDs, all of which can be used in the circuit of FIG. 1.

Referring now to FIG. 2, a current/voltage control circuit 100 can be the same as or similar to one of the current/voltage control circuits 64*a*-64*c* of FIG. 1. A current controlled circuit 102 can be the same as or similar to one of the current controlled circuits 66*a*-66*c* of FIG. 1.

The current controlled circuit 102 includes a current sense output node 112 at which a current sense signal 114 is provided representative of a current flowing through the current controlled circuit 102. The current controlled circuit 102 also includes a voltage sense output node 104 at which a voltage sense signal 106 is provided representative of a voltage at the voltage sense output node 104. The current controlled circuit 102 also includes a control node 108 configured to receive a control signal 136 to control the current flowing through the current controlled circuit 102. The voltage sense signal 106 can be the same as or similar to one of the voltage sense signals 72*a*-72*c* of FIG. 1. The current sense signal 114 can be the same as or similar to one of the current sense signals 76*a*-76*c* of FIG. 1. The control signal 136 can be the same as or similar to one of the control signals 74*a*-74*c* of FIG. 1.

The voltage sense output node 104 can be coupled to a cathode end of a series connected diode string 122, which can be light emitting LEDs. The anode end of the series connected LED string 122 can be coupled to a voltage signal 120. The voltage signal 120 can be a regulated voltage signal provided by a switching regulator, and can be the same as or similar to the regulated output voltage signal 24 of FIG. 1.

The current controlled circuit 102 can include a transistor, for example, a field effect transistor (FET) 116 having a source node coupled to a resistor 118. In some arrangements the FET 116 is an N-channel FET or NFET. The resistor 118 can couple at its other end to a reference voltage, for example, a ground reference voltage. The FET 116 also has a drain node coupled to the cathode end of the series connected LED string 122.

The current/voltage control circuit 100 can include an error amplifier 134 having two inputs, one input coupled to receive the voltage sense signal 106 and the other input coupled to receive a predetermined reference signal 130. The predetermined reference signal 130 is referenced to, and can be close to, zero volts. For example, the predetermined reference signal 130 can be one volt. In some arrangements, an output signal 132 from the error amplifier 134 is a continuously valued analog signal related to a difference between the voltage sense signal 106 and the predetermined reference signal. In some other arrangements, when the voltage sense signal 106 is above the predetermined reference signal 130, the output signal 132 from the error amplifier 134 achieves a first state, and when the voltage sense signal 106 is below the predetermined reference signal 130, the output signal 132 achieves a second different state.

The current/voltage control circuit 100 can also include a pulse width modulation (PWM) controller 129 coupled to receive the current sense signal 114 and also coupled to receive a predetermined reference signal 128. The predetermined reference signal 128 is referenced to, and can be close to, zero volts. For example, the predetermined reference signal 128 can be between 0.5 volts and one volt. In some embodiments, the PWM controller 129 is coupled to receive an external PWM signal 146. The external PWM signal 146 can be the same as or similar to the external PWM signal 78 of FIG. 1.

The PWM controller 129 is configured to generate a PWM output signal 138. The PWM output signal 138 is a two state binary signal having a relatively invariant frequency but a controllable duty cycle, which is controlled by the input signals 146, 128, 114. It will become apparent that a first state of the PWM output signal 138 corresponds to a first time interval during which a first current is passed through the current controlled circuit 102, and the second state of the PWM output signal 138 corresponds to a second time interval during which a second current (e.g., zero) is passed through the current controlled circuit 102, as similarly described above in conjunction with FIG. 1. These first and second currents and associated first and second time intervals are the same first and second currents and associated first and second time intervals described above in conjunction with FIG. 1.

The current/voltage control circuit 100 can also include a first switch 133 coupled to receive the output signal 132 from the error amplifier 134 and coupled to receive, as a control signal, the PWM output signal 138 from the PWM controller 129. The first switch 133 is also coupled to the control node 108.

The current/voltage control circuit 100 can also include an inverter 140 coupled to receive the PWM output signal 138 from the PWM controller 129. The inverter 140 is configured to generate an inverted PWM output signal 142.

The current/voltage control circuit 100 can also include a second switch 144 coupled between the control node 108 and a reference voltage, for example, a ground reference voltage. The second switch 144 is coupled to receive, as a control signal, the inverted PWM output signal 142. Thus, it should be apparent that, in operation, the first and second switches 133, 144, respectively, open and close in opposition to each other, causing the control signal 136 to the FET 116 to take on a value equal to the output signal 132 of the error amplifier 134 during the first time intervals during which the current controlled circuit 102 passes the first current, and a value of zero volts during the second time intervals during which the current controlled circuit 102 passes the second current, which can be substantially zero. Since the output signal 132 from the error amplifier is related to the voltage sense signal 106, the first current during the first time interval is controlled to result in the above-described predetermined voltage at the voltage sense output node 104 during the first time interval.

It will be further understood that, in operation, the PWM signal 138 is controlled to have a duty cycle resulting in the above-described predetermined average current, by comparing the current sense signal 114 with the predetermined reference signal 128.

The external PWM signal 146 can be used by the PWM controller 129 to shut down the PWM output signal 138, i.e., to cause the first switch 133 to open and the second switch 144 to close during one of the two states of the external PWM signal 146. During the other state of the external PWM signal 146, the circuit 100 can operate as described above. To this end, the external PWM signal 146 can have a frequency lower than the frequency of the PWM output signal 138. For example, the external PWM signal can have a frequency in the range of about twenty to one hundred Hz. The PWM output signal 138 can have a frequency in the range of about 200 Hz to 10 kHz. A duty cycle of the external PWM signal 146 can control the brightness of the series connected LED string 122.

Figure 2A:
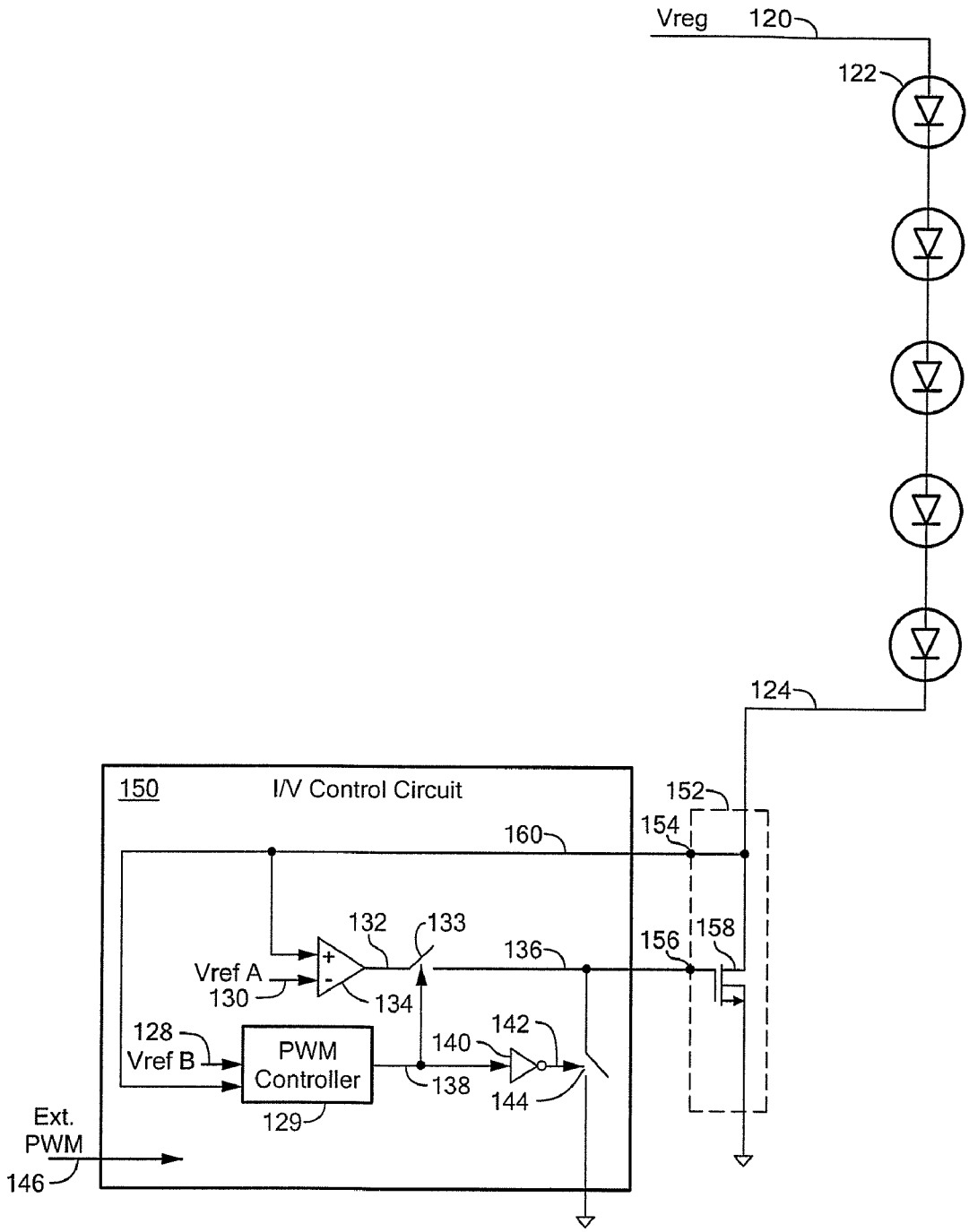
FIG. 2A is a block diagram of another current/voltage control circuit coupled to a current controlled circuit, which is coupled to LEDs, all of which can be used in the circuit of FIG. 1.

Referring now to FIG. 2A, in which like elements of FIG. 2 are shown having like reference designations, a current/voltage control circuit 150 is coupled to a current controlled circuit 152. Unlike the current controlled circuit 102 of FIG. 2, the current controlled circuit 152 includes a node 154, which is a dual purpose node, operating both as a current sense output node and as a voltage sense output node, taking the place of the current sense output node 112 and the voltage sense output node 104 of FIG. 2. It will be recognized that the current controlled circuit 152 does not include the resistor 118 of FIG. 2. Instead, the current controlled circuit includes only a FET 158 that acts as a controlled resistor. Essentially, when the FET 158 is controlled to be on and passing the first current during the first time interval, a current/voltage sense signal 160 is indicative of both a voltage appearing at the dual purpose node 154 and also of a current passing through the FET 158, since the FET 158 has a known resistance. In other words, the desired predetermined voltage appearing at the dual-purpose node 154 during the first time interval corresponds to a known current since the resistance of the FET is known.

The error amplifier 134 is coupled to receive the current/voltage sense signal 160. Instead of the current sense signal 114 of FIG. 2, the PWM controller 129 is coupled to receive the current/voltage sense signal 160.

Operation of the current/voltage control circuit 150 and current controlled circuit 152 is similar to that described above in conjunction with FIG. 2.

Figure 3:
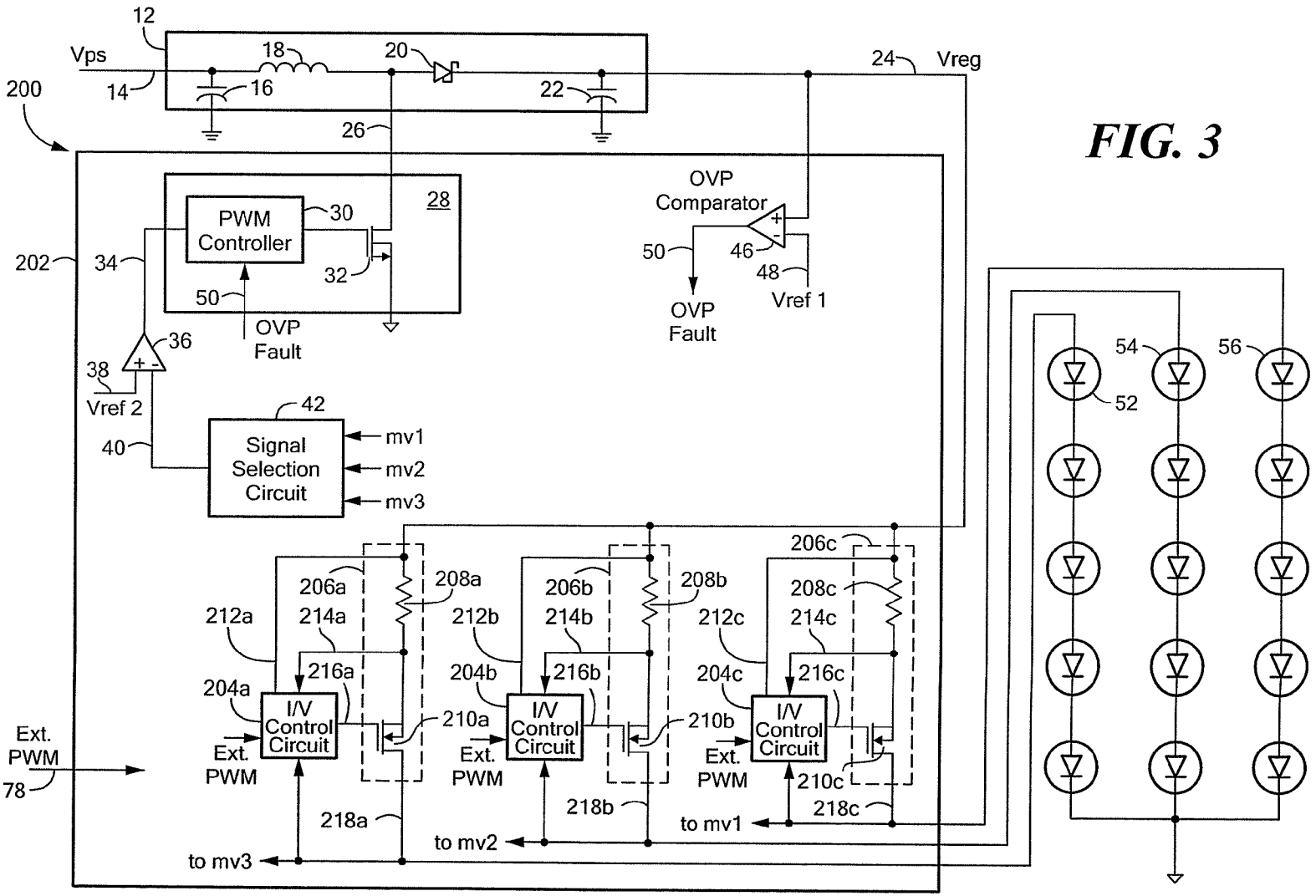
FIG. 3 is a block diagram of another electronic circuit for driving a diode load, the electronic circuit having current controlled circuits and current/voltage control circuits configured to provide control of a boost switching regulator.

Referring now to FIG. 3, in which like elements of FIG. 1 are shown having like reference designations, a circuit 200 includes an integrated circuit 202 similar to the integrated circuit 80 of FIG. 1. The circuit 200 also includes the boost switching regulator 12 and the series connected LED strings 52-56. However, the integrated circuit 202 is coupled to the anode side of the series connected LED strings 52-56 rather than to the cathode side as in FIG. 1. Furthermore, the switching regulator 12 is coupled to the integrated circuit 202 rather than to the anode side of the series connected LED strings 52-56 as in FIG. 1.

The integrated circuit 202 includes current/voltage control circuits 204*a*-204*c* coupled to current controlled circuits 206*a*-206*c*. The current controlled circuits 206*a*-206*c* include resistors 208*a*-208*c*, respectively, coupled to receive the regulated output voltage 24 from the switching regulator 12. The current controlled circuits 206*a*-206*c* also include FETs 210*a*-210*c*, respectively, each one having a source coupled to a respective one of the resistors 208*a*-208*c* and each one have a drain coupled to a respective one of the a series connected LED strings 52-56.

The current controlled circuits 206*a*-206*c* provide current sense signals 214*a*-214*c*, respectively, and voltage sense signals 218*a*-218*c*, respectively. The current controlled circuits 206*a*-206*c* are coupled to receive control signals 216*a*-216*c* from current/voltage control circuits 204*a*-204*c*, which are coupled to receive the current sense signals 214*a*-214*c* and the voltage sense signals 218*a*-218*c*.

Function of the circuit 200 is the same as or similar to function of the circuit 10 of FIG. 1. Function of the circuit 200 will be further understood from the discussion below in conjunction with FIG. 4.

Figure 4:
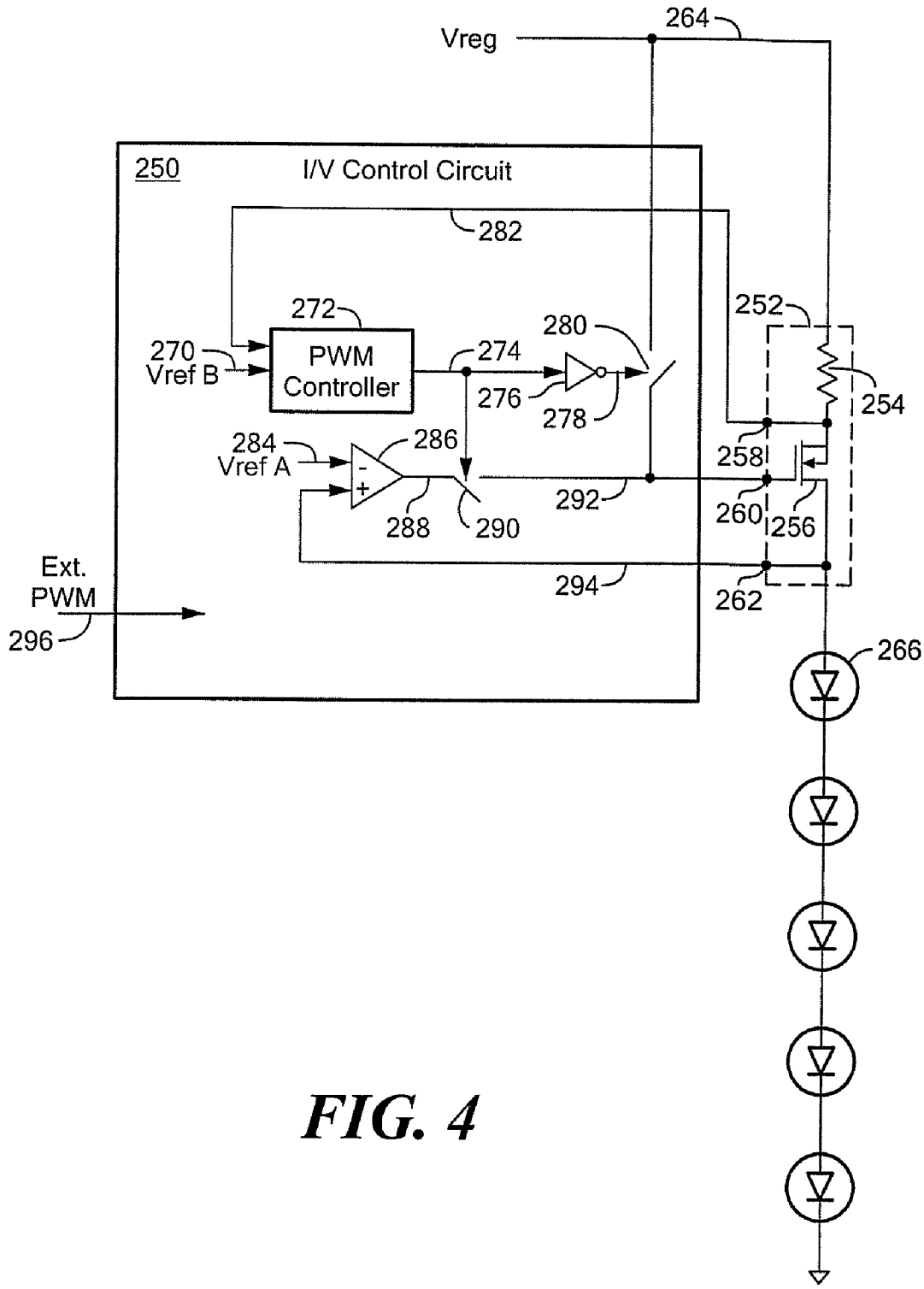
FIG. 4 is a block diagram of a current/voltage control circuit coupled to a current controlled circuit, which is coupled to LEDs, all of which can be used in the circuit of FIG. 3.

Referring now to FIG. 4, current/voltage control circuit 250 can be the same as or similar to one of the current/voltage control circuits 204*a*-204*c* of FIG. 3. A current controlled circuit 252 can be the same as or similar to one of the current controlled circuits 206*a*-206*c* of FIG. 3.

The current controlled circuit 252 includes a current sense output node 258 at which a current sense signal 282 is provided representative of a current flowing through the current controlled circuit 252. The current controlled circuit 252 also includes a voltage sense output node 262 at which a voltage sense signal 294 is provided representative of a voltage at the voltage sense output node 262. The current controlled circuit 252 also includes a control node 260 configured to receive a control signal 292 to control the current flowing through the current controlled circuit 252. The voltage sense signal 294 can be the same as or similar to one of the voltage sense signals 218*a*-218*c* of FIG. 3. The current sense signal 282 can be the same as or similar to one of the current sense signals 214*a*-214*c* of FIG. 3. The control signal 260 can be the same as or similar to one of the control signals 216*a*-216*c* of FIG. 3.

The voltage sense output node 262 can be coupled to an anode end of a series connected LED string 266. The cathode end of the series connected LED string 122 can be coupled to a reference voltage, e.g., ground.

The current controlled circuit 252 can include a transistor, for example, a field effect transistor (FET) 256 having a source node coupled to a resistor 254. In some arrangements the FET 256 is a P-channel FET or PFET. The resistor 254 can couple at its other end to a voltage signal 264, as may, for example, be provided by a switching regulator, for example, the switching regulator 12 of FIG. 3. The FET 256 also has a drain node coupled to the anode end of the series connected LED string 266.

The current/voltage control circuit 250 can include an error amplifier 286 having two inputs, one input coupled to receive the voltage sense signal 294 and the other input coupled to receive a predetermined reference signal 284. The predetermined reference signal 284 is referenced to, and can be close to, the voltage signal 264, for example, one volt below the voltage signal 264. In some arrangements, an output signal 288 from the error amplifier 286 is a continuously valued analog signal related to a difference between the voltage sense signal 294 and the predetermined reference signal 284. In some other arrangements, when the voltage sense signal 294 is above the predetermined reference signal 284, the output signal 288 from the error amplifier 286 achieves a first state, and when the voltage sense signal 294 is below the predetermined reference signal 284, the output signal 288 achieves a second different state.

The current/voltage control circuit 250 can also include a pulse width modulation (PWM) controller 272 coupled to receive the current sense signal 282 and coupled to receive a predetermined reference signal 270. The predetermined reference signal 270 is referenced to, and can be close to, the voltage signal 264, for example, in the rage of 0.5 to one volt below the voltage signal 264. In some embodiments, the PWM controller 272 is coupled to receive an external PWM signal 296. The external PWM signal 296 can be the same as or similar to the external PWM signal 78 of FIG. 3.

The PWM controller 272 is configured to generate a PWM output signal 274. The PWM output signal 274 is a two-state signal having a duty cycle controlled by the input signals 282, 270. It will become apparent that a first state of the PWM output signal 274 corresponds to a first time interval during which a first current is passed through the current controlled circuit 252, and the second state of the PWM output signal 274 corresponds to a second time interval during which a second current (e.g., zero) is passed through the current controlled circuit 252, as similarly described above in conjunction with FIGS. 1 and 3.

The current/voltage control circuit 250 can also include a first switch 290 coupled to receive the output signal 288 from the error amplifier 286 and coupled to receive, as a control signal, the PWM output signal 274 from the PWM controller 272. The first switch 290 is also coupled to the control node 260.

The current/voltage control circuit 250 can also include an inverter 276 coupled to receive the PWM output signal 274 from the PWM controller 272 and configured to generate an inverted PWM output signal 278.

The current/voltage control circuit 250 can also include a second switch 280 coupled to receive, as a control signal, the inverted PWM output signal 278. The second switch is also coupled between the control node 260 and the voltage signal 264. Thus, it should be apparent that, in operation, the first and second switches 290, 280, respectively, open and close in opposition to each other causing the control signal 292 to the FET 256 to take on a value equal to the output signal 288 at some time intervals, during which the current controlled circuit 252 passes the first current, and a value of the voltage signal 264 at other time intervals, during which the current controlled circuit 252 passes the second current, which can be substantially zero. Since the output signal 288 is related to the voltage sense signal 294, the first current during the first time interval is controlled to result in the above-described predetermined voltage at the voltage sense output node 262 during the first time interval.

It will be further understood that, in operation, the PWM output signal 274 is controlled to have a duty cycle resulting in the above-described predetermined average current, by comparing the current sense signal 282 with the predetermined reference signal 270.

The external PWM signal 296 can be used by the PWM controller 272 to shut down the PWM output signal 274, i.e., to cause the first switch 290 to open and the second switch 280 to close during one of the two states of the external PWM signal 296. During the other state of the external PWM signal 296, the circuit 250 can operate as described above. To this end, the external PWM signal 296 can have a frequency lower than the frequency of the PWM output signal 274. For example, the external PWM signal 296 can have a frequency in the range of about twenty to one hundred Hz. The PWM output signal 274 can have a frequency in the range of about 200 Hz to 10 kHz. A duty cycle of the external PWM signal 296 can control the brightness of the series connected LED string 266.

Figure 4A:
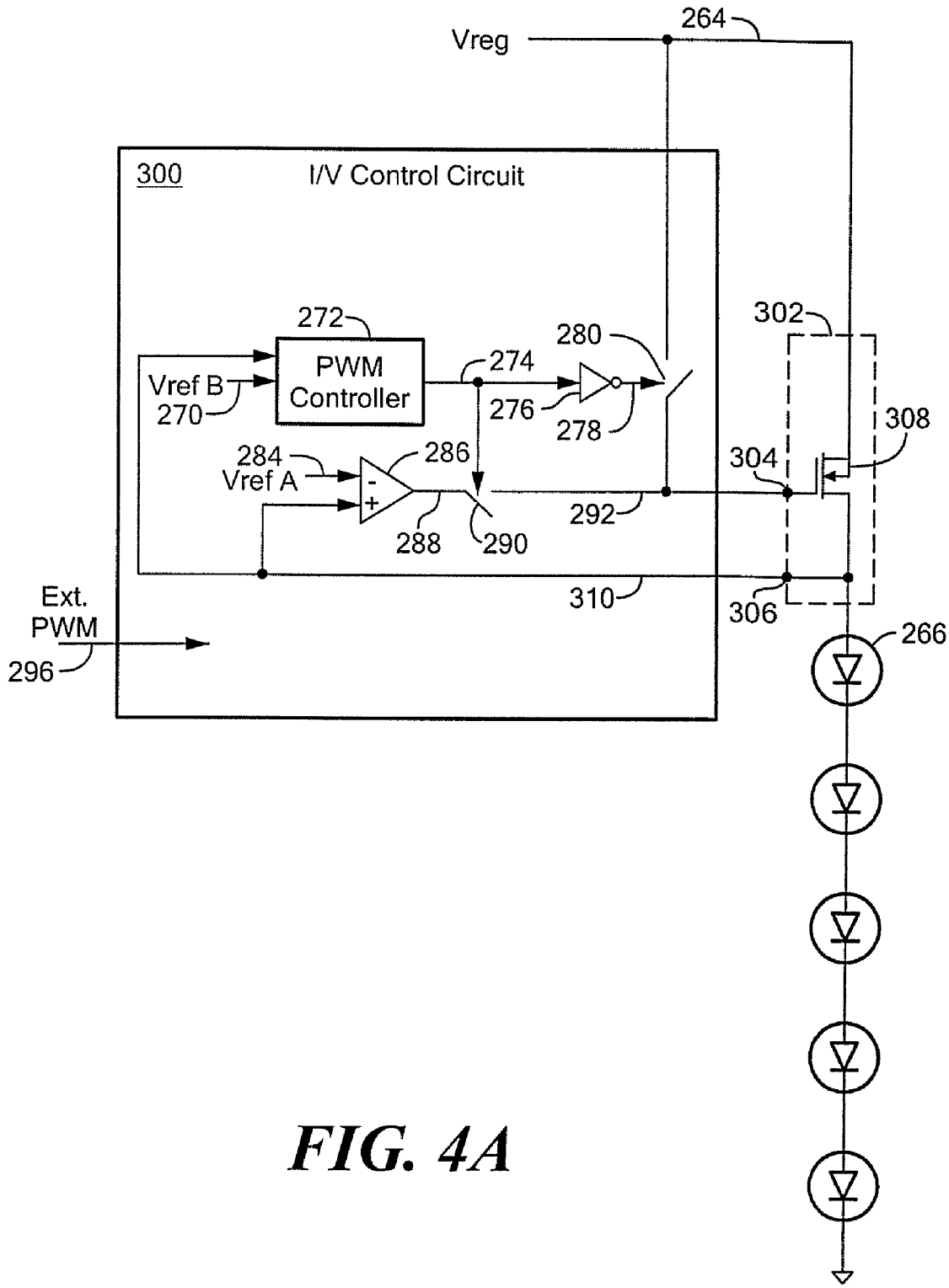
FIG. 4A is a block diagram of another current/voltage control circuit coupled to a current controlled circuit, which is coupled to LEDs, all of which can be used in the circuit of FIG. 1.

Referring now to FIG. 4A, in which like elements of FIG. 4 are shown having like reference designations, a current/voltage control circuit 300 is coupled to a current controlled circuit 302. Unlike the current controlled circuit 252 of FIG. 4, the current controlled circuit 302 includes a node 306, which is a dual purpose node, operating both as a current sense output node and as a voltage sense output node, taking the place of the current sense output node 258 and the voltage sense output node 262 of FIG. 4. It will be recognized that the current controlled circuit 302 does not include the resistor 254 of FIG. 4. Instead, the current controlled circuit 302 includes only a FET 308 that acts as a controlled resistor. Essentially, when the FET 308 is controlled to be on and passing the first current during the first time interval, a current/voltage sense signal 310 is indicative of both a voltage appearing at the dual purpose node 306 and also of a current passing through the FET 308, since the FET 308 has a known resistance. In other words, the desired predetermined voltage appearing at the dual-purpose node 306 during the first time interval corresponds to a known current since the resistance of the FET 308 is known.

The error amplifier 286 is coupled to receive the current/voltage sense signal 310. Instead of the current sense signal 282 of FIG. 4, the PWM controller 272 is coupled to receive the current/voltage sense signal 310.

Operation of the current/voltage control circuit 300 and current controlled circuit 302 is similar to that described above in conjunction with FIG. 4.

Figure 5:
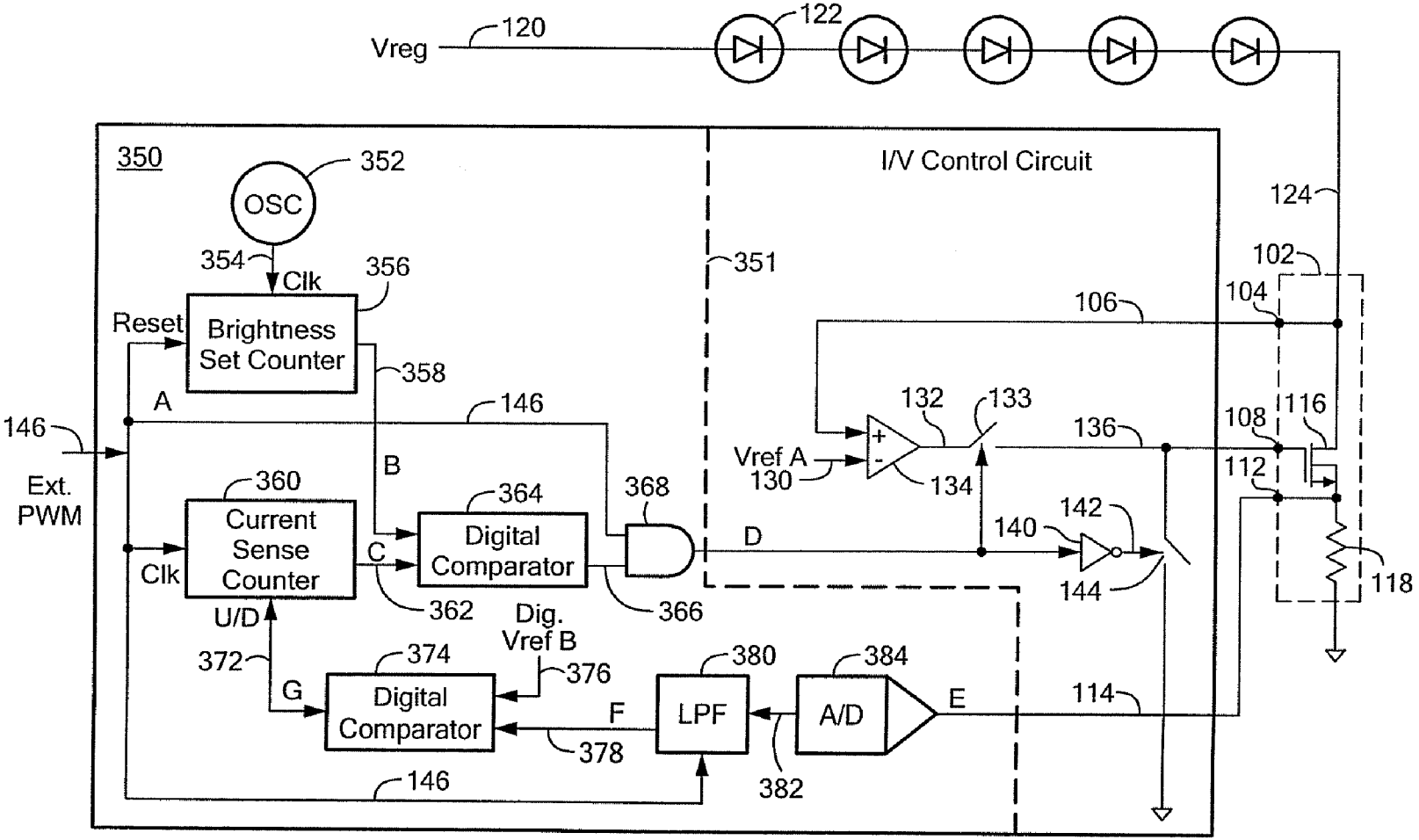
FIG. 5 is a block diagram of another current/voltage control circuit coupled to a current controlled circuit, which is coupled to LEDs, all of which can be used in the circuit of FIG. 1.

Referring now to FIG. 5, in which like elements of FIG. 2 are shown having like reference designations, a current/voltage control circuit 350 can be the same as or similar to one of the current/voltage control circuits 64*a*-64*c* of FIG. 1. The current controlled circuit 102 can be the same as or similar to one of the current controlled circuits 66*a*-66*c* of FIG. 1. Operation of the current/voltage control circuit 350 is described more fully below in conjunction with FIG. 5A.

The current/voltage control circuit 350 includes components the same as or similar to the current/voltage control circuit 100 of FIG. 2 to the right side of a dashed line 351, and different components to the left side of the dashed line. It will become apparent that the components to the left side of the dashed line 351 can take the place of the PWM controller 129 of FIG. 1. In essence, the new components allow a way to dim the series connected LED string 122 with the external PWM signal 146, but in a different way than ways described above.

Like the above describe circuits that achieve a predetermined voltage at a voltage sense output node (e.g., node 104) of a current controlled circuit (e.g., 102) and achieve a predetermined average current passing through the current controlled circuit (e.g., 102), the current/voltage control circuit 350 of FIG. 5 achieves a similar outcome, but in a different way. It will become apparent that the circuit of FIG. 5 achieves a predetermined voltage at the voltage sense output node 104 of the current controlled circuit 102. However, the predetermined average current is achieved only during particular time periods, namely, during time periods of a particular state of the external PWM signal 146. Furthermore, as will become apparent from discussion below, since the time periods between the selected state of the external PWM signal 146 (i.e., time periods of the other state) can be varied or adjusted, the current/voltage control circuit 350 also achieves a selectable average current passing through the current controlled circuit 102. The selectable average current is associated with a selected brightness of the series connects LED string 122.

As described above in conjunction with FIG. 2, the current/voltage control circuit 350 can include the error amplifier 134 having two inputs, one input coupled to receive the voltage sense signal 106 and the other input coupled to receive the predetermined reference signal 130. The predetermined reference signal 130 is referenced to, and can be close to, zero volts. For example, the predetermined reference signal 130 can be one volt. In some arrangements, an output signal 132 from the error amplifier 134 is a continuously valued analog signal related to a difference between the voltage sense signal 106 and the predetermined reference signal 130. In some other arrangements, when the voltage sense signal 106 is above the predetermined reference signal 130, the output signal 132 from the error amplifier 134 achieves a first state, and when the voltage sense signal 106 is below the predetermined reference signal 130, the output signal 132 achieves a second different state.

The current/voltage control circuit 350 can include an oscillator 352 configured to generate an oscillating binary signal 354. In some arrangements, the oscillating binary signal 354 has a relatively high frequency, for example, a frequency in the range of one hundred Kilohertz to one Megahertz.

A counter 356, referred to herein as a "brightness set counter," is coupled to receive the oscillating binary signal 354 at a clock (Clk) input. The brightness set counter 356 is also coupled to receive the external PWM signal 146 at an inverted reset input. Therefore, it will be appreciated that the brightness set counter 356 is configured to count pulses or edges of the oscillating binary signal 354 when the external PWM signal 146 is in a selected state, e.g., in a high state, and the brightness set counter 356 is reset to a count of zero when the external PWM signal is in the other state, e.g., a low state. The brightness set counter 356 is configured, therefore, to generate a digital signal 358, which, in operation, ramps up in digital value during the selected state of the PWM signal, and which signal achieves a highest value proportional to a time interval of the selected state of the external PWM signal 146.

The current/voltage control circuit 350 can also include an A/D (analog-to-digital) converter 384 coupled to the current sense node 112 of the current controlled circuit 102. The A/D converter 384 is configured to generate a digital signal 382 representative of current flowing through the resistor 118.

The digital signal 382 is received by a digital filter 380 configured to generate a filtered output signal 378. The filtered output signal 378 is representative of the predetermined average current flowing through the resistor 116 when the external PWM signal 146 is in theabove-described selected state. The low pass filter 380 can be coupled to receive the external PWM signal 146. With this arrangement, in operation, the filtered signal 378 can move toward the output signal 114 when the external PWM signal 146 is in one state, and can hold the value when the external PWM signal 146 is in the other state. This operation is described more fully below in conjunction with FIG. 5A.

The filtered output signal 378 is received by a digital comparator 374, which also receives a digital reference signal 376. In one particular embodiment, the digital reference signal 376 is representative of about 200 millivolts. The digital comparator 374 is configured to generate a first comparison signal 372, which achieves a particular state when the filtered signal 378 is below the digital reference signal 376, and which achieves another different state when the filtered signal 378 is above the digital reference signal 376.

A counter 360, referred to herein as a "current sense counter" 360 is coupled to receive the first comparison signal 372 at an up/down (U/D) control input and to receive the external PWM signal at a clock input. Therefore, the current sense counter counts up on selected edges of the external PWM signal 146 when the first comparison signal 372 is in a selected state. Conversely, the current sense counter 360 counts down when the first comparison signal 372 is in the other state.

The current sense counter 360 is configured to generate a digital signal 362. A digital comparator 364 is coupled to receive the digital signal 358, and also to receive the digital signal 362.

The digital comparator 364 is configured to generate an output signal 366, which is received by an AND gate 368. The external PWM signal 146 is also received by the AND gate. The AND gate 368 generates a signal 370, which is received by the switch 133 and by the inverter 140.

While the current/voltage control circuit 350 is shown that provides the current controlled circuit 102 coupled to cathode end of the series connected LED string 122, it will be appreciated that, like the circuit 250 of FIG. 4, an alternate arrangement can be provided that places a circuit similar to the current/voltage control circuit 350 at the anode end of a series connected string of LEDs.

Figure 5A:
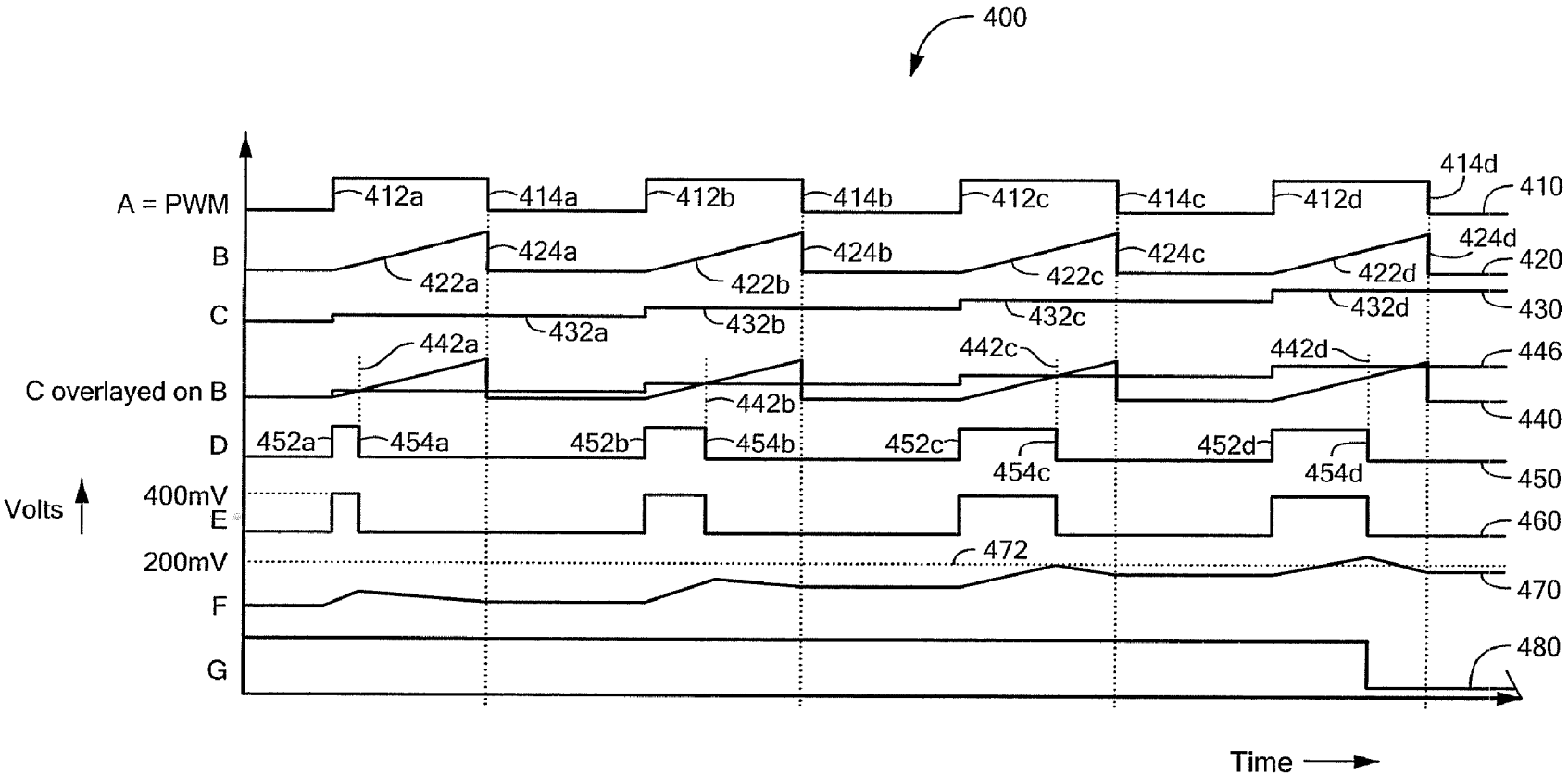
FIG. 5A is a graph showing waveforms (signals) indicative of operation of the current/voltage control circuit of FIG. 5.

Referring now to FIG. 5A, a graph 400 includes a horizontal axis in units of time in arbitrary time units, and a vertical axis in units of volts. Waveforms, i.e., signals, 410, 420, 430, 440, 450, 460, 470, 480, are also labeled with reference designators A-G, respectively, which designators are shown in FIG. 5. Thus, the signals 410, 420, 430, 440, 450, 460, 470, 480 are representative of signals at reference designators A-G in FIG. 5.

The signal 410 is representative of the external PWM signal 146 of FIG. 5, and can have a frequency and duty cycle. The frequency can be in the range of about 50 Hz to about 100 kHz, so as to be lower in frequency than the signal 354, and so as to be high enough to result in any flicker in the LEDs 122 being unapparent. The signal 410 can have a duty cycle between one percent and 99 percent. The signal 410 has rising edges 412*a*-412*d* and falling edges 414*a*-414*d*.

The signal 420 is representative of the signal 358 of FIG. 5. The signal 420, though shown in analog form, is indicative of digital values that count upward in ramps 422*a*-422*d*, as generated by the brightness set counter 356 of FIG. 5. Each one of the ramp 422*a*-422*d* begins at a time corresponding to a respective one of the rising edges 412*a*-412*d* of the signal 410, and each one of the ramp 422*a*-422*d* ends at a time corresponding to a respective one of the falling edges 414*a*-414*d* of the signal 410.

A curve 430 is representative of the signal 362 of FIG. 5. The signal 430, though shown in analog form, is indicative of digital values that count upward in steps, as generated by the brightness set counter 356 of FIG. 5.

Signal 440 is the same as the signal 420, and signal 446 is the same as the signal 430, but shown overlayed to indicate a comparison made by the digital comparator 364 of FIG. 5. Signals 440 and 446 cross at times 442*a*-442*d*.

A signal 450 is representative of the signal 370 of FIG. 5. The signal 450 has rising edges 452*a*-452*d* at times corresponding to the rising edges 412*a*-412*d* of the signal 410, and falling edges 454*a*-454*d* corresponding to the times 442*a*-442*d* associated with the crossings of the signals 440 and 446.

A signal 460 is representative of the signal 385 of FIG. 5. The signal 460 has pulses with amplitudes near to or corresponding to voltages appearing on the resistor 118 of FIG. 5 at times when the switch 386 of FIG. 5 is closed, e.g., when the signal 410 is in a high state. Here, pulses having an amplitude of about four hundred millivolts are shown. It should be appreciated that the pulses in the signal 460 tend to be shorter than the pulses in the signal 410.

A signal 470 is representative of the signal 378 of FIG. 5. During times when the signal 410 is high, the signal 470 tends to rise when the signal 460 is high and tends to fall when the signal 460 is low. During times when the signal 410 is low, the signal 470 holds its value.

The signal 470 is associated with a threshold 472, which corresponds to the digital reference signal 376 of FIG. 5.

A signal 480 is representative of the signal 372 of FIG. 5. The signal 480 achieves a first state, e.g., a high state, when the signal 470 is below the threshold 472, and the signal 480 achieves a second different state, e.g., a low state, when the signal 470 is above the threshold 472. Hysteresis can be applied to hold the signal 480 low when the signal 470 goes slightly below the threshold 472, as occurs, for example, just prior to the time 442*d*. However, in other embodiments, no hysteresis is used and instead the signal 480 will jitter between two states as the signal 470 rises above and falls below the threshold 472. This can result in the current sense counter 360 jittering about a desired value.

Once a steady state is achieved, for example, at time 424*d*, though not shown, the signal 480 begins to toggle between the two states and the signal 446 begins to count up then count down periodically.

With this arrangement, it can be seen that the signal 450, which controls the current controlled circuit 102 of FIG. 5, has pulses with a frequency the same as the frequency of the external PWM signal 410, but with pulse time durations related to a current passing through the resistor 118 of FIG. 5, of which the amplitudes of the pulses of the signal 460 are representative. If, for example, the pulses of the signal 460 had a lower amplitude than the four hundred millivolts indicated (i.e., a lower current were flowing), then the signal 470 would take longer to approach the threshold 472, resulting in a longer high time of the signal 480, which, in turn, would result in a higher count value of the signal 430 (and 440), which, in turn would result in longer pulses in the signal 450. In other words, if the current passing through the resistor 118 of FIG. 5 is reduced during the pulses of the signal 460, then pulses appearing in the signal 450 (and 460 and 368 of FIG. 5) become longer, thereby causing the current within any high state of the external PWM signal 410 to achieve a above-described predetermined average current. Conversely, if the current passing through the resistor 118 of FIG. 5 is increased during the pulses of the signal 460, then pulses appearing in the signal 450 (and 460 and 368 of FIG. 5) become shorter, thereby causing the current within any high state of the external PWM signal 410 to achieve approximately the same predetermined average current.

It should be apparent that the low periods of the external PWM signal 410 (146 of FIG. 5) can be increased in time duration to dim the series connected LED string 122 and can be decreased to brighten the series connected LED string 122, while still achieving theabove-described predetermined average current during any high state of the external PWM signal 410. In this way, the above-described selectable average current is achieved. Thus, the external PWM signal 410 (146 of FIG. 5) can be associated with brightness of the series connected LED string 122 of FIG. 5 in a way different than ways described above.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. An electronic circuit, comprising:

a current controlled circuit having a current sense output node at which a current sense signal is provided representative of a current flowing through the current controlled circuit, a voltage sense output node at which a voltage sense signal is provided representative of a voltage at the voltage sense output node, and a control node configured to receive a control signal to control the current flowing through the current controlled circuit; and a current/voltage control circuit having a current sense input node, a voltage sense input node, and an output node, wherein the current sense input node of the current/voltage control circuit is coupled to the current sense output node of the current controlled circuit, wherein the voltage sense input node of the current/voltage control circuit is coupled to the voltage sense output node of the current controlled circuit, wherein the output node of the current/voltage control circuit is coupled to the control node of the current controlled circuit, and wherein the current/voltage control circuit is configured to provide the control signal at the output node of the current/voltage control circuit resulting in a predetermined voltage at the voltage sense output node of the current controlled circuit and resulting in a predetermined average current passing through the current controlled circuit, the predetermined average current resulting by way of a feedback loop comprising the coupling between the current sense input node of the current/voltage control circuit and the current sense output node of the current controlled circuit.

2. The electronic circuit of claim 1, wherein the current controlled circuit comprises:

a transistor having an input node, an output node, and a control node, wherein the control node of the transistor is coupled to the control node of the current controlled circuit, wherein a selected one of the input node or the output node of the transistor is coupled to the voltage sense output node of the current controlled circuit, and wherein the unselected one of the input node or the output node of the transistor is coupled to the current sense output node of the current controlled circuit; and a resistor having a node coupled to the current sense output node of the current controlled circuit.

3. The electronic circuit of claim 1, wherein the control signal provided by the current/voltage control circuit includes first and second signal values, wherein the first signal value is generated in order to achieve the predetermined voltage at the voltage sense output node of the current controlled circuit, wherein the predetermined voltage corresponds to a first current passing through the current controlled circuit, and wherein the second signal value is generated in order to achieve a second different current passing through the current controlled circuit.

4. The electronic circuit of claim 3, wherein the second different current is approximately zero.

5. The electronic circuit of claim 3, wherein the first and second signal values have respective durations controlled by the current/voltage control circuit.

6. The electronic circuit of claim 5, wherein the respective durations of the first and second signal values are controlled in order to achieve the predetermined average current passing through the current controlled circuit.

7. The electronic circuit of claim 1, wherein the current/voltage control circuit comprises:

an error amplifier having first and second input nodes and an output node, wherein the first input node of the error amplifier is coupled to the voltage sense input node of the current/voltage control circuit and the second input node of the error amplifier is coupled to a first reference voltage; and a first switch coupled between the output node of the error amplifier and the output node of the current/voltage control circuit.

8. The electronic circuit of claim 7, wherein the current/voltage control circuit further comprises:

a pulse width modulation circuit having first and second input nodes and an output node, wherein the output node of the pulse width modulation module is coupled to control the first switch, wherein the first input node of the pulse width modulation circuit is coupled to the current sense input node of the current/voltage control circuit, and wherein the second input node of the pulse width modulation circuit is coupled to a second reference voltage; and a second switch coupled to the output node of the current/voltage control circuit, wherein the second switch is configured to be closed when the first switch is opened and opened when the first switch is closed.

9. The electronic circuit of claim 1, further comprising:

a signal selection circuit having an input node and an output node, wherein the input node of the signal selection circuit is coupled to the voltage sense output node of the current controlled circuit, wherein the signal selection circuit is configured to provide a signal at the output node of the signal selection circuit indicative of a sensed voltage at the voltage sense output node of the current controlled circuit; and a switching circuit having a switching node and a control node, wherein the control node of the switching circuit is coupled to the output node of the signal selection circuit, wherein a duty cycle of the switching circuit is responsive to the signal at the output node of the signal selection circuit.

10. The electronic circuit of claim 9, further comprising an over-voltage detection circuit having an input node and an output node, wherein the input node of the over-voltage detection circuit is coupled to the switching node of the switching circuit, wherein the output node of the over-voltage protection circuit is coupled to the switching circuit.

11. The electronic circuit of claim 1, wherein the electronic circuit is coupled to receive a pulse width modulated signal and wherein the predetermined average current is achieved during first states of the received pulse width modulated signal, wherein a selectable average current is achieved in accordance with a selectable time period of second different states of the pulse width modulated signal.

12. An electronic circuit for lighting a light emitting diode having an anode and a cathode, the electronic circuit comprising:

a current controlled circuit having a current sense output node at which a current sense signal is provided representative of a current flowing through the current controlled circuit, a voltage sense output node at which a voltage sense signal is provided representative of a voltage at the voltage sense output node, and a control node configured to receive a control signal to control the current flowing through the current controlled circuit, wherein the voltage sense output node of the current controlled circuit is configured to couple to a selected one of the anode or the cathode of the light emitting diode;

a switching regulator having an input node, an output node, and a control node, wherein the output node of the switching regulator is configured to couple to a selected one of the anode of the light emitting diode or to the voltage sense output node of the current controlled circuit; and a current/voltage control circuit having a current sense input node, a voltage sense input node, and an output node, wherein the current sense input node of the current/voltage control circuit is coupled to the current sense output node of the current controlled circuit, wherein the voltage sense input node of the current/voltage control circuit is coupled to the voltage sense output node of the current controlled circuit, wherein the output node of the current/voltage control circuit is coupled to the control node of the current controlled circuit, and wherein the current/voltage control circuit is configured to provide the control signal at the output node of the current/voltage control circuit resulting in a predetermined voltage at the voltage sense output node of the current controlled circuit and resulting in a predetermined average current passing through the current controlled circuit, the predetermined average current resulting by way of a feedback loop comprising the coupling between the current sense input node of the current/voltage control circuit and the current sense output node of the current controlled circuit.

13. The electronic circuit of claim 12, wherein the current controlled circuit comprises:

a transistor having an input node, an output node, and a control node, wherein the control node of the transistor is coupled to the control node of the current controlled circuit, wherein a selected one of the input node or the output node of the transistor is coupled to the voltage sense output node of the current controlled circuit, and wherein the unselected one of the input node or the output node of the transistor is coupled to the current sense output node of the current controlled circuit ; and a resistor having a node coupled to the current sense output node of the current controlled circuit.

14. The electronic circuit of claim 12, wherein the control signal provided by the current/voltage control circuit includes first and second signal values, wherein the first signal value is generated in order to achieve the predetermined voltage at the voltage sense output node of the current controlled circuit, wherein the predetermined voltage corresponds to a first current passing through the current controlled circuit, and wherein the second signal value is generated in order to achieve a second different current passing through the current controlled circuit.

15. The electronic signal of claim 14, wherein the second different current is approximately zero.

16. The electronic circuit of claim 14, wherein the first and second signal values have respective durations controlled by the current/voltage control circuit.

17. The electronic circuit of claim 16, wherein the respective durations of the first and second signal values are controlled in order to achieve the predetermined average current passing through the current controlled circuit.

18. The electronic circuit of claim 12, wherein the current/voltage control circuit comprises:

an error amplifier having first and second input nodes and an output node, wherein the first input node of the error amplifier is coupled to the voltage sense input node of the current/voltage control circuit and the second input node of the error amplifier is coupled to a first reference voltage; and a first switch coupled between the output node of the error amplifier and the output node of the current/voltage control circuit.

19. The electronic circuit of claim 18, wherein the current/voltage control circuit further comprises:

a pulse width modulation circuit having first and second input nodes and an output node, wherein the output node of the pulse width modulation module is coupled to control the first switch, wherein the first input node of the pulse width modulation circuit is coupled to the current sense input node of the current/voltage control circuit, and wherein the second input node of the pulse width modulation circuit is coupled to a second reference voltage; and a second switch coupled to the output node of the current/voltage control circuit, wherein the second switch is configured to be closed when the first switch is opened and opened when the first switch is closed.

20. The method of claim 19, wherein the pulsing comprises:

generating a control signal having first and second signal values wherein the first and second signal values have respective durations;

coupling the control signal to the control node of the current controlled circuit; and controlling the respective durations of the first and second signal values in order to achieve the predetermined average current passing through the LED and through the current controlled circuit.

21. The method of claim 20, further comprising:

detecting a voltage at the voltage sense output node of the current controlled circuit; and generating a selected regulated voltage with a switching regulator in accordance with the detecting, wherein the selected regulated voltage is selected to achieve at least the predetermined voltage at the voltage sense output node of the current controlled circuit.

22. A method for an LED driver circuit comprising a switching regulator, the method comprising:

passing a first current through an LED and through a current controlled circuit having a current sense output node, a voltage sense output node, and a control node, wherein the first current is selected to result in a predetermined voltage at the voltage sense output node of the current controlled circuit; and alternating between the first current and a second different current passing through the LED and through the current controlled circuit in order to achieve a predetermined average current through the LED and through the current controlled circuit, the predetermined average current resulting by way of a feedback loop comprising the current sense output node.

* * * * *

UNITED STATES PATENT AND TRADEMARK OFFICE

CERTIFICATE OF CORRECTION

PATENT NO. : 7,999,487 B2
APPLICATION NO. : 12/136347
DATED : August 16, 2011
INVENTOR(S) : Gregory Szczeszynski It is certified that error appears in the above-identified patent and that said Letters Patent is hereby corrected as shown below:

Column 1, line 33 delete “configured” and replace with --is configured--.

Column 5, line 58 delete “be come” and replace with --become--.

Column 6, lines 36-37 delete “circuit” and replace with --circuits--.

Column 6, line 42 delete “circuit” and replace with --circuits--.

Column 8, lines 35-36 delete “be being” and replace with --be--.

Column 8, line 42 delete “circuit” and replace with --circuits--.

Column 8, line 47 delete “circuit” and replace with --circuits--.

Column 8, line 51 delete “above-describe” and replace with --above-described--.

Column 8, line 52 delete “circuit” and replace with --circuits--.

Column 9, line 6 delete “string” and replace with --strings--.

Column 12, line 12 delete “have” and replace with --having--.

Column 12, lines 12-13 delete “the a series” and replace with --the series--.

Column 13, line 13 delete “rage” and replace with --range--.

Column 14, line 53 delete “above describe” and replace with --above-described--.

Column 15, line 4 delete “connects” and replace with --connected--.

Column 15, line 53 delete “theabove-described” and replace with --the above-described--.

Column 16, line 22 delete “to cathode” and replace with --to the cathode--.

Column 16, line 48 delete “ramp” and replace with --ramps--.

Column 17, line 50 delete “ramp” and replace with --ramps--.

Signed and Sealed this
Third Day of July, 2012

David J. Kappos

David J. Kappos
*Director of the United States Patent and Trademark Office*